United States Patent [19]

Szabo

[11] Patent Number: 4,686,905

[45] Date of Patent: Aug. 18, 1987

[54] CARTRIDGE FOR FRANGIBLE PROJECTILE

[76] Inventor: Attila Szabo, 33 Côte Ste-Catherine, Outremont, Province of Quebec, Canada

[21] Appl. No.: 759,461

[22] Filed: Jul. 26, 1985

[51] Int. Cl.[4] ..... F42B 5/30; F42B 7/02; F42B 11/18

[52] U.S. Cl. ..... 102/444; 42/76.01; 102/470

[58] Field of Search ..... 102/470, 430, 469, 513, 102/443, 444, 447, 466, 467; 42/76.01

[56] References Cited

U.S. PATENT DOCUMENTS

| | | | |
|---|---|---|---|
| 740,790 | 10/1903 | Young et al. | 102/470 |
| 1,760,731 | 5/1930 | Williams | 42/76.01 |
| 2,316,172 | 4/1943 | Kowalski | 102/513 |
| 2,869,270 | 1/1959 | Simmons | 42/76.01 |
| 3,031,966 | 5/1962 | Metzger | 102/444 |
| 3,049,828 | 8/1962 | Mills | 42/54 |
| 3,238,657 | 3/1966 | Foote et al. | 42/76.01 |
| 3,429,263 | 2/1969 | Snyder et al. | 102/513 |
| 3,649,020 | 3/1972 | Hall | 273/428 |
| 3,782,286 | 1/1974 | Jones et al. | 102/502 |
| 3,865,038 | 2/1975 | Barr | 102/502 |
| 3,877,375 | 4/1975 | Barr | 102/470 |
| 3,901,158 | 8/1975 | Ferb | 102/512 |
| 3,983,817 | 10/1976 | Tucker | 102/513 |
| 4,007,690 | 2/1977 | Wildridge | 102/395 |
| 4,027,592 | 6/1977 | Hübsch et al. | 102/470 X |
| 4,389,939 | 6/1983 | Ofuji | 102/458 |

FOREIGN PATENT DOCUMENTS

| | | | |
|---|---|---|---|
| 315255 | 11/1919 | Fed. Rep. of Germany | 102/470 |

*Primary Examiner*—Deborah L. Kyle
*Assistant Examiner*—Ted L. Parr

[57] ABSTRACT

A cartridge with a frangible projectile, usable in an automatic or semi-automatic fire-arm, for instance a pistol, wherein the propellant gases are initially expanded to recoil the breech block and then further expanded to propel the frangible projectile without breaking the same until impact.

14 Claims, 14 Drawing Figures

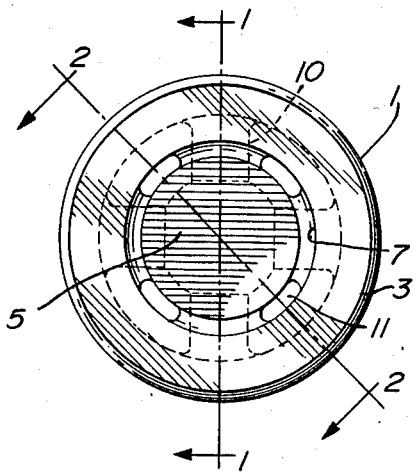
Fig. 3
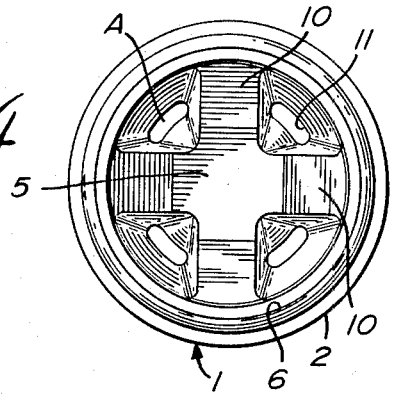
Fig. 4
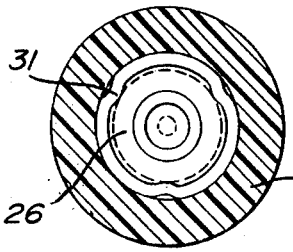
Fig. 8
Fig. 9
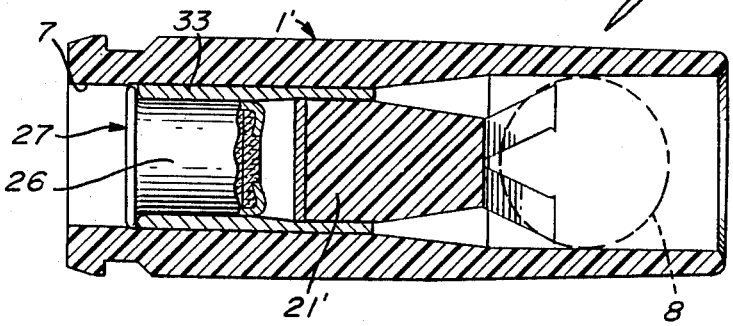

CARTRIDGE FOR FRANGIBLE PROJECTILE

FIELD OF THE INVENTION

The present invention relates to a cartridge for use in battle games, riot control, fire-arm training and the like, and in which the projectile is frangible that is rupturable upon target impact to release a fluid-like substance, such as a target marking dye, a soporific substance or the like.

BACKGROUND OF THE INVENTION

Up to now, to applicant's knowledge, it has been impossible to fire a frangible projectile of the above-noted type in an automatic or semi-automatic manner. If the frangible projectile is fitted to a conventional cartridge, the breech block of an automatic weapon will not retract to its cocked position if the amount of gun powder used is low enough to prevent rupture of the frangible projectile within the gun barrel. If the amount of powder is high enough to fully recoil the breech block, then detonation of the powder will cause rupture of the projectile within its cartridge or within the gun barrel.

OBJECTS OF THE INVENTION

It is therefore the general object of the present invention to provide an ammunition round in which the projectile is of the frangible type and which can be fired by an automatic as well as a non-automatic weapon.

Another object of the present invention is to provide a cartridge with a frangible projectile incorporating its own firing pin in such a manner that the fire-arm designed to fire such a cartridge will be incapable of firing the conventional ammunition round for increased safety in the use of this fire-arm.

Yet another object of the present invention is to provide a cartridge with a frangible projectile which is of simple and inexpensive construction, consisting of a minimum of parts and most parts made of injection molded plastic.

SUMMARY OF THE INVENTION

The cartridge in accordance with the invention comprises an open-ended tubular casing having an intermediate partition defining within the casing a front compartment frictionally and sealingly receiving a frangible projectile, and a rear compartment in which a piston member is movable and defines a variable volume chamber therein said chamber located between said piston member and said partition. Said partition has an aperture communicating said front and rear compartments and said piston, when in a forward position, substantially sealing said aperture, and when moving to a rearward position, expanding said chamber and then uncovering said aperture. A propellant charge is located within the chamber, which, upon detonation, produces propellant gases, causing the piston member to slide rearwardly, thus expanding said chamber and then uncovering said aperture to allow the propellant gases to enter the front compartment behind the projectile and propel the same. In this manner, the propellant gases are partially expanded to a lower pressure before they act on the frangible projectile, so that they can propel the latter without breaking the same. The rearwardly-movable piston is also used to recoil the breech block in an automatic or semi-automatic weapon used to launch the frangible projectile.

In accordance with a preferred embodiment, the projectile assembly incorporates its own firing pin.

BRIEF DESCRIPTION OF THE DRAWINGS

FIG. 3 is a back end view OF THE cartridge casing.

FIG. 4 is a front end view of the cartridge casing;

FIG. 8 is a cross-section taken along line 8—8 of FIG. 7;

FIG. 9 is a longitudinal section of a third embodiment, but otherwise similar to that of FIG. 5;

DETAILED DESCRIPTION OF THE PREFERRED EMBODIMENTS

Figure 1:
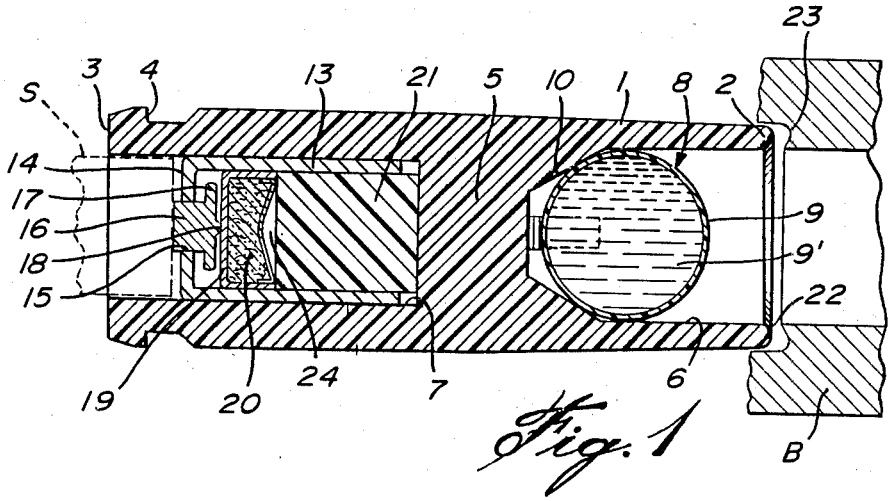
FIG. 1 is a longitudinal section of the first embodiment of the cartridge of the invention before firing, this section being taken along line 1—1 of FIG. 3.
Figure 5:
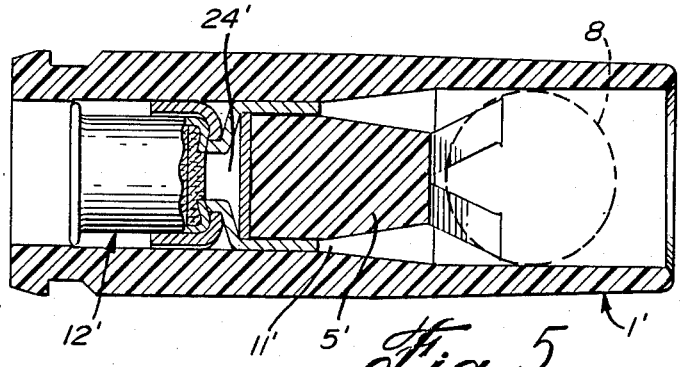
FIG. 5 is a longitudinal section of a second embodiment in the non-fired condition.
Figure 6:
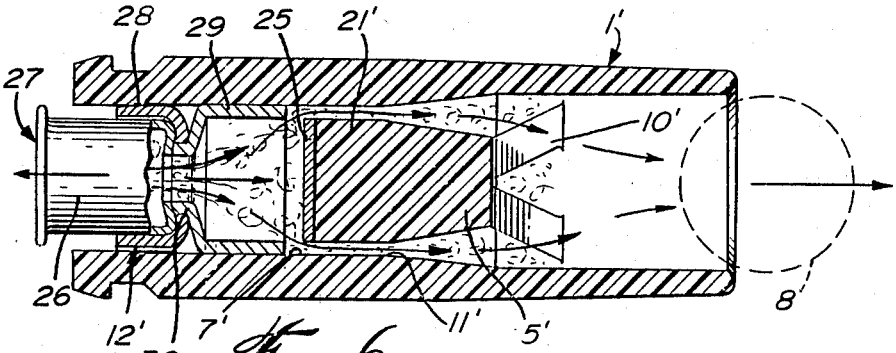
FIG. 6 is a similar section of the second embodiment after firing.
Figure 7:
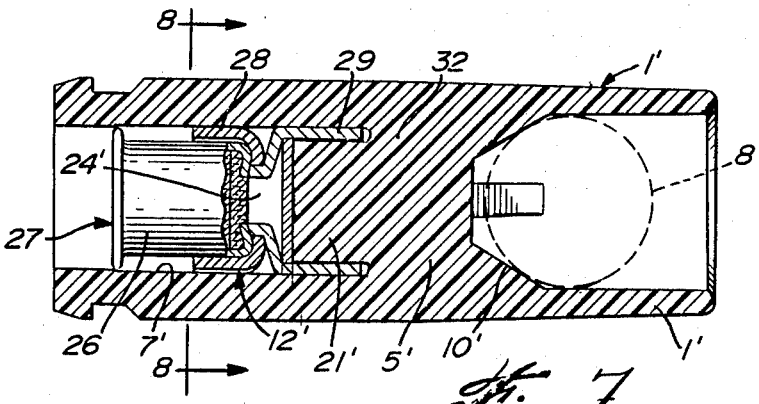
FIG. 7 is a longitudinal section of the second embodiment before firing and taken at right angle to the section of FIG. 5.

FIG. 1 shows a preferred embodiment of the cartridge in accordance with the invention, which comprises a cartridge casing 1, of generally externally cylindrical shape, having a front end 2 and a rear end 3, the latter provided with a conventional annular groove 4 for spent cartridge extracting purposes.

Casing 1 has an intermediate partition 5 which defines, within the casing 1, a front compartment 6 and a rear compartment 7, which are of generally cylindrical shape and which open to the exterior at front end 2 and rear end 3, respectively. Front compartment 6 is adapted to sealingly and frictionally retain a frangible projectile, indicated at 8, that is a projectile which will rupture upon target impact. Such a projectile may consist of a skin 9, of a rupturable material, such as gelatin, containing a powder or a liquid, or a gas, to be released upon target impact. Such a substance 9' can be a liquid dye or a watersoluble paint, or other coloring agent, if used for target marking.

For riot-control purposes, the agent could be a soporific substance or a tear gas product, or similar substances. The partition 5 has radially- and forwardly-tapering legs 10 which are annularly spaced within the forward compartment; said legs 10 serve to reinforce the partition 5 against the impact of the propellant gases upon detonation and also serve as a seat for the projectile 8.

In the drawings, four equally- angularly-spaced legs 10 are shown, but such a number can vary. The partition 5 is provided between each pair of legs 10 with an aperture 11 making communication between the front and rear compartments 6 and 7, respectively. These apertures 11 in the embodiment described are located at the periphery of the partition, that is, adjacent the inner surface of a casing 1.

A piston member 12 is slidably fitted within the rear compartment 7. Piston member 12 has front sleeve portion 13 and a rear radially-inturned flange 14 defining a central hole 15, in which a firing pin 16 is slidably retained. Said firing pin has an enlarged front head 17 adapted to overlap the rear flange 14 and prevent rearward movement of the firing pin 16 relative to the piston member 12 when the head 17 seats on the rear flange 14. In this latter position, the rear end of the firing pin 16 protrudes from the rear flange 14. The front head 17 has a central firing point 18; immediately forwardly of the firing pin is frictionally fitted within the sleeve portion 13 a conventional primer cap 19, made of metal and containing gun powder 20, such as smokeless powder.

A cylindrical plunger 21 is slidably fitted within the sleeve portion 13 and abuts against the primer cap 19. This plunger 21 in turn abuts the rear face of the partition 5. Preferably, the plunger 21 is made of plastic material and also the casing 1, its partition 5 and its legs 10. Preferably, casing 1, partition 5 and legs 10 are made as a one-piece unit by injection molding of the plastic material.

Plunger 21 could also be made an integral part of the partition 5, if desired.

The front end 2 of the casing 1 is radially rearwardly tapered or inclined, as shown at 22, and is adapted to seat against a mating step 23 made in the barrel B of the weapon in which the cartridge is inserted. This to prevent radially inward collapse of the plastic material of the casing 1 which might otherwise occur upon firing of the ammunition.

In the nonfired condition of the assembly as shown in FIG. 1, the piston member 12 is in advanced position with its sleeve portion 13 effectively sealing the apertures 11 and, consequently, the communication between the rear and front compartments 7 and 6, respectively.

Figure 2:
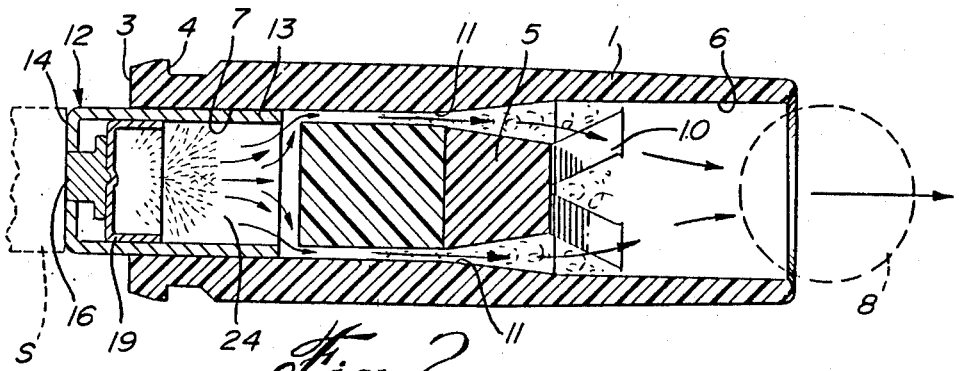
FIG. 2 is a longitudinal section of the same embodiment after firing, this section being taken along line 2—2 of FIG. 3.

When striker member S of the fire-arm strikes the projecting end of the firing pin 16, the latter is pushed forwardly and ignites the primer cap 19. The propellant gases resulting from the detonation of the primer cap and which are initially confined within the chamber 24 defined by the piston member 12, the firing pin 16 and the plunger 21, produces rearward sliding movement of piston member 12 to a rear position, as shown in FIG. 2. During this rearward movement, the gases expand within the chamber 24 and, finally, the sleeve portion 13 clears the rear end of plunger 21, thereby causing communication between the chamber 24 and the portion of the front compartment 6 behind the projectile 8, the latter being then propelled forwardly and out of the barrel B.

Because the propellant gases are initially allowed to expand within the chamber 24 before they reach the projectile 8, the gas pressure exerted on the projectile 8 is much lower than otherwise and the projectile will not rupture until its impact on the target.

In an automatic or semi-automatic weapon, the striker S is part of the breech block assembly and the rearward movement of the piston member 12 causes full recoil of the breech block assembly for automatic or semi-automatic operation of the weapon.

In the embodiment shown, the firing pin is incorporated with the projectile assembly and, therefore, this provides added safety in the handling of the weapon used to fire the projectile assembly, because the striker part of the breech block S can be made to a diameter just to slidably fit the rear compartment 7, as shown in FIG. 1. Therefore, a firearm provided with such a striker S could not fire a standard primer cap, or the primer cap of a conventional cartridge, the striker portion of such cap having a diameter much less than that of the striker S. Therefore, the fire-arm user could not accidentally insert a standard lethal cartridge in the weapon.

Although the projectile 8, shown in FIG. 1, is of spherical shape, it is obvious that it could have an oval shape and still frictionally fit within the front compartment 6. Other shapes could be envisaged.

It will be noted that during initial firing, the expanding gases act on the partition 5 and the casing 1 is caused to firmly seat on the step 23 of the fire-arm barrel B. Therefore, no locking mechanism is required to lock the casing 1 in position with the barrel.

In the second embodiment as shown in FIGS. 5 to 8, the casing 1' is similar to casing 1, being provided with legs 10' and the apertures 11', as legs 10 and aperture 11 of the first embodiment and as shown in FIGS. 3 and 4.

The part corresponding to plunger 21 of the first embodiment is shown at 21', being an integral part of the partition 5'. The rear face of said part 21' is preferably lined by a metallic disc 25. The piston member 12' consists of the shell 26 of a conventional primer cap 27 and of a two-part sleeve portion 28,29 secured to each other at their adjoining ends, said adjoining ends,indicated at 30, forming a radially-inwardly-extending step. The rear sleeve portion 28 frictionally retains the shell 26, being provided with longitudinal inward indentations 31 engaging the outer surface of the shell 26, should the diameter of such shell be less than the internal diameter of the sleeve portion 28. Forward sleeve portion 29 is in slidable contact with both the internal surface of the rear compartment 7' and the external surface of the plunger part 21' while the rear sleeve portion 29 is in sliding contact with the internal surface of the rear compartment 7'. Sleeve portion 28, 29, together with the shell 26 of the primer cap 27, form a unitary assembly which constitutes the piston member 12'. The free space between the front of the primer cap 27 and the disc 25, together with sleeve portions 28, defines the gas expansion chambers 24'.

As in the first embodiment, in the advanced position of the piston member 12' the apertures 11' are sealed; detonation of primer cap 27, when hit by a conventional firing pin of the fire-arm, causes, as in the first embodiment, initial expansion of the propellant gases within chamber 24', which causes rearward movement of the piston member 12'. Then the gases are allowed to enter the front compartment behind the projectile 8 to propel the same; the gas pressure will be low enough, so that the projectile will not rupture. Rearward movement of the primer cap 27 will cause recoil and recocking of the breech block of an automatic or semi-automatic fire-arm.

The piston assembly 12' is maintained in proper position within the casing 1', because the front end of the front sleeve portion 29 abuts the webs 32 extending between the apertures 11' and joining the partition to the rest of the casing 1'.

FIG. 9 shows a third embodiment which is simplified construction with respect to the second embodiment of FIGS. 5 to 8. The casing 1' is exactly the same as in the second embodiment. The same type of primer cap 27 is used, the only difference being that the two part sleeve portion of the piston assembly is replaced by a single cylindrical sleeve 33, having a friction fit with the shell 26 of the primer cap 27, so as to form a piston assembly with the same and having a sliding fit with the inner surface of the rear compartment 7' and with the external surface of the plunger part 21'. The action is exactly the same as in the second embodiment.

Figure 10:
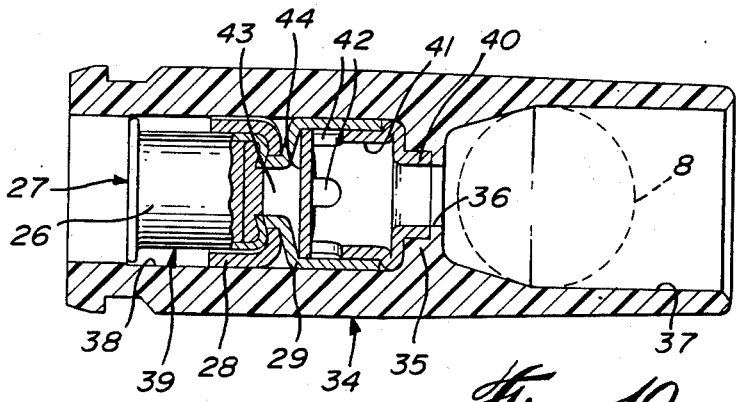
FIG. 10 is a longitudinal section of a fourth embodiment before firing.
Figure 11:
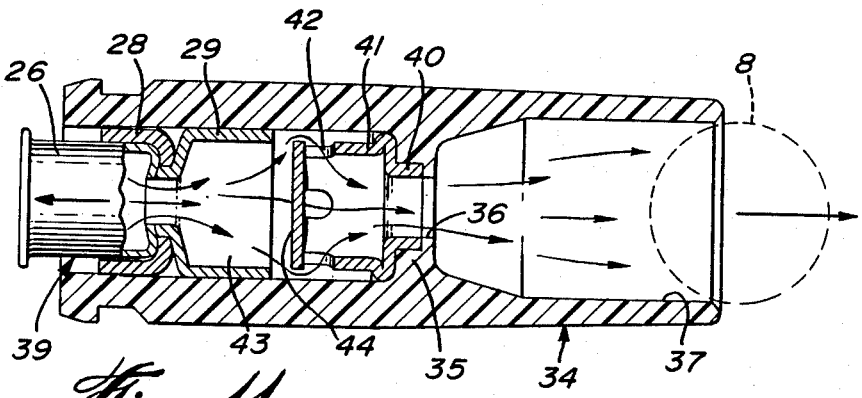
FIG. 11 is a section similar to that of FIG. 10 but after firing.

FIGS. 10 and 11 show a fourth embodiment. Cartridge casing 34 has an intermediate partition 35 provided with a central aperture 36 and delimiting a front compartment 37 for frictionally and sealingly retaining the frangible projectile 8 and a rear compartment 38 in which is slidably mounted the piston assembly 39. A hollow metallic bushing 40 is fitted within the aperture 36 and has a lateral wall 41 which is radially inwardly spaced from and concentric with the inner surface of the rear compartment 38, and which is provided with apertures 42 communicating with the central aperture 36 through the hollow bushing.

The piston assembly 39 is formed, as in the second embodiment, of the shell 26 of the primer cap 27 and of sleeve portions 28, 29, the front sleeve portion 29 sealing the additional apertures 42 in the forward position of the piston assembly and uncovering said additional apertures 42 in the rear position of the piston assembly, as shown in FIG. 11.

The gas expansion chamber 43 is defined by the sleeve portions 28, 29, the primer cap 27 and the rear wall 44 of the hollow bushing 40. Upon rearward movement of the piston assembly 39, the gases expand within the chamber 43 and only reach the projectile when they have attained a lower pressure.

Figure 12:
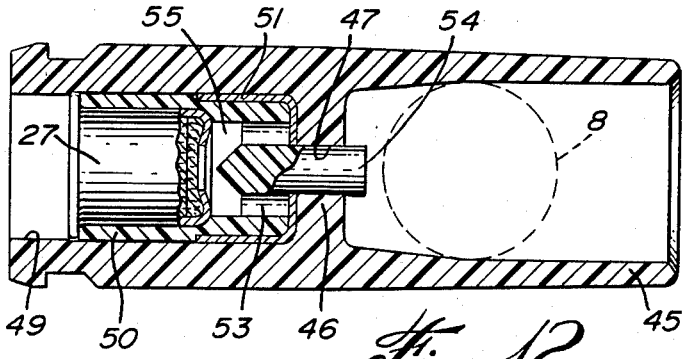
FIG. 12 and FIG. 13 are longitudinal sections of a fifth embodiment before and after firing.
Figure 13:
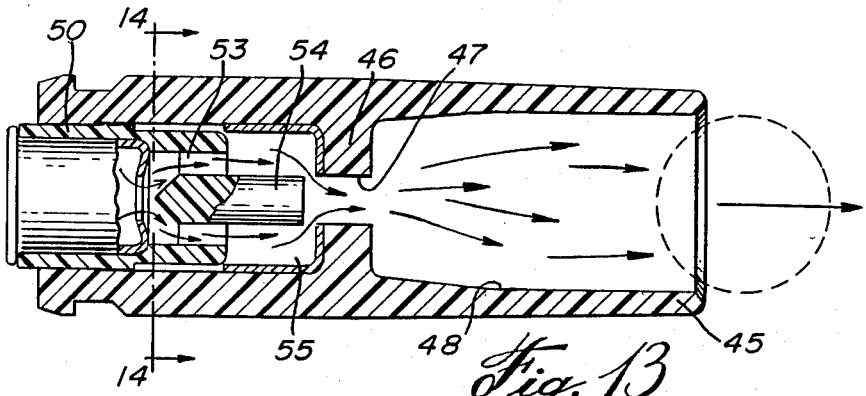
Figure 14:
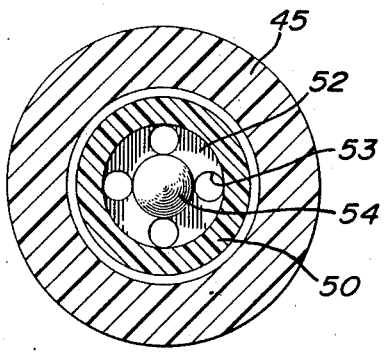
FIG. 14 is a cross-section taken along line 14—14 of FIG. 13.

FIGS. 12 to 14 show a fifth embodiment. The casing 45 has an intermediate integral partition 46 provided with a central aperture 47, said partition defining a front projectile-receiving compartment 48 and a rear piston assembly-receiving compartment 45. The piston assembly consists of the conventional primer cap 27 frictionally retained within a sleeve member 50 which has a sliding fit with the rear compartment 49. This sleeve member 50 has a front portion,of reduced diameter, to slidably fit within a metal lining 51 formed at the front portion of the rear compartment 49.

Sleeve 50 has at its forward end a transverse wall 52 provided with through bores 53 surrounding a central cylindrical plug 54 which extends co-axially of the piston assembly and of the rear compartment and which enters and seals the central aperture 47 in the advanced position of the piston assembly, as shown in FIG. 12, and which uncovers said central aperture 47 in the rearward position of the central assembly.

As in the other embodiments, the gas expansion chamber 55 expands in volume during movement of the piston assembly from its forward to its rear position.

What I claim is:

1. A fire-arm cartridge comprising an open-ended tubular casing having an intermediate partition defining in the casing a front and a rear compartment, a frangible projectile frictionally and sealingly retained in said front compartment, said partition having an aperture communicating said front and rear compartments, a piston assembly including a sleeve and slidable within said rear compartment for movement between a forward position in which said sleeve substantially seals the communication through said aperture, and a rearward position in which said sleeve uncovers the communication through said aperture, and a propellant charge located within said sleeve, which, upon detonation, produces propellant gases which first cause said piston assembly to move rearwardly and then to cause said sleeve to uncover said aperture and allow said propellant gases to enter said front compartment behind said projectile and propel the same.

2. A firearm cartridge as defined in claim 1, wherein said propellant charge is enclosed in a primer cap located in said sleeve, and further including a firing pin and a plunger located within said sleeve behind and in front of said primer cap, respectively, said plunger extending rearwardly from said partition and said primer cap abutting said plunger and said firing pin.

3. A fire-arm cartridge as defined in claim 2, wherein said sleeve has a radially-inwardly extending flange at its rear end defining a rear hole, of smaller diameter than the internal diameter of said sleeve, said firing pin extending and movable through said rear hole and protruding from said flange, having a front head of greater cross-sectional size than that of said firing pin and overlapping said flange to prevent rearward movement of said pin relative to said sleeve when said front head abuts said flange.

4. A fire-arm cartridge as defined in claim 3, wherein said casing and said partition are made of a unitary injection-molded plastic piece, said plunger is made of plastic and said sleeve and firing pin are made of metal.

5. A fire-arm cartridge as defined in claim 3, wherein said firing pin has a rear free end recessed within said casing.

6. A fire-arm cartridge as defined in claim 1, wherein said projectile is a hollow, gelatin capsule rupturable upon impact and filled with a fluid-like substance.

7. A fire-arm cartridge as defined in claim 1, wherein said propellant charge is enclosed in a primer cap located in said sleeve.

8. A fire-arm cartridge as defined in claim 7, wherein said casing is made of plastifc material, and wherein the front edge of said casing is inwardly rearwardly tapered to be retained against inward collapse by a mating step in the firing arm barrel.

9. A fire arm cartridge as defined in claim 1, wherein said propellant charge is included in a primer cap fitted and retained within a sleeve, the latter and said cap forming said piston assembly and wherein said aperture, together with additional similar apertures, are located adjacent the inner surface of said casing spacedly around said partition.

10. A fire-arm cartridge as defined in claim 9, wherein said sleeve has an intermediate portion forming a radially-inwardly-protruding rib overlapping the front end of said primer cap and defining said chamber between said cap and said partition.

11. A fire-arm cartridge as defined in claim 1, wherein said aperture is a central aperture located in the center of said partition, and further including a hollow bushing fixed to said partition and extending rearwarwardly therefrom into said rear compartment, said bushing having a lateral wall inwardly spaced from the inner surface of said casing, said lateral wall having additional apertures communicating with said central aperture, said piston assembly including a sleeve extending around said lateral wall and sealing said additional apertures in said forward position and uncovering said additional apertures in said rearward position.

12. A fire-arm cartridge as defined in claim 1, wherein said casing and partition are made of a unitary injection-molded plastic piece, and wherein said partition has radially- and forwardly-tapering legs and annularly spaced within said forward compartment, reinforcing said partition and forming a seat for said projectile, said legs being integral with said partition and casing.

13. A frangible projectile assembly as defined in claim 1, wherein said piston assembly has a slidable sealing fit with the internal surface of said casing to prevent gas escape from the rear end of said casing, the rear end of said piston assembly being recessed within the rear end portion of said casing in the forward position of said piston assembly.

14. A fire-arm cartridge as defined in claim 1, wherein said aperture is a central aperture made in the centre of said partition and said sleeve carries a central plug surrounded by additional apertures, said plug inserted into and sealing said central aperture in the forward position of said piston assembly and withdrawn from said central aperture in the rearward position of said piston assembly.

* * * * *